US006238135B1

(12) United States Patent
Röwer

(10) Patent No.: US 6,238,135 B1
(45) Date of Patent: May 29, 2001

(54) PAVER HAVING ADJUSTABLE SCREED ANGLE USING A TAMPER BAR

(75) Inventor: Maik Röwer, Obernkirchen (DE)

(73) Assignee: ABG Allgemeine Baumaschinengesellschaft mbH (DE)

( * ) Notice: Subject to any disclaimer, the term of this patent is extended or adjusted under 35 U.S.C. 154(b) by 0 days.

(21) Appl. No.: 09/372,340

(22) Filed: Aug. 11, 1999

(30) Foreign Application Priority Data

Aug. 11, 1998 (DE) ..... 198 36 269

(51) Int. Cl.[7] ..... E01C 19/34
(52) U.S. Cl. ..... 404/84.5; 404/133.05
(58) Field of Search ..... 404/84.05, 84.1, 404/84.5, 133.05, 133.2, 118

(56) References Cited

U.S. PATENT DOCUMENTS 3,877,830 * 4/1975 James, III ..... 404/84.1
3,989,402 * 11/1976 James, III ..... 404/84.1 X
4,127,351 * 11/1978 Vural ..... 404/133.05 X
4,493,585 * 1/1985 Axer ..... 404/133.05 X
5,735,634 * 4/1998 Ulrich et al. ..... 404/102
6,027,282 * 2/2000 Horn ..... 404/84.1 X

FOREIGN PATENT DOCUMENTS

4139702 * 5/1993 (DE) .

* cited by examiner

*Primary Examiner*—David Bagnell
*Assistant Examiner*—Sunil Singh
(74) *Attorney, Agent, or Firm*—Michael Best & Friedrich LLP

(57) ABSTRACT

A paver has a chassis and a trailing floating screed which is articulated on the chassis by a pair of tension arms. The setting angle of the screed relative to the ground is capable of being adjusted via actuating cylinders. The screed includes at least one tamper bar that is movable in upward and downward directions by a drive and having a variable number of strokes. Further, the screed has a bottom-side smoothing plate. At least one sensor configured for measuring the setting angle is provided in the vicinity of the rear end of the screed. The sensor is connected to an associated controller which is capable of adjusting the number of strokes or stroke rate of the tamper bar in order to adjust the setting angle of the screed to a predetermined desired value.

8 Claims, 2 Drawing Sheets

PAVER HAVING ADJUSTABLE SCREED ANGLE USING A TAMPER BAR

BACKGROUND OF THE INVENTION

The present invention relates to paving machines or pavers, and more particularly to pavers having a floating screed assembly.

A paver typically includes a chassis and a trailed (i.e., pulled from the rear) screed assembly which is articulated on the chassis by means of tension arms, commonly referred to as a "floating" screed. The "setting angle" of the screed relative to the ground (also referred to as the angle of attack) is capable of being adjusted, generally by means of actuating cylinders. Such screeds often include at least one tamper bar that is movable in upward and downward directions by means of a drive (e.g., a linkage driven by a rotating motor shaft) so as to have variable number of strokes. In other words, the drive is preferably adjustable so as to vary the stroke rate, the number of strokes per a unit of time, of the tamper bar. Further, the screed includes a bottom-side smoothing plate, also called a screed plate, which generally must have a "positive" setting angle when a mix of paving material is being paved. In other words, the front edge (i.e., "front" with respect to the direction of travel or paving direction) of the smoothing plate/screed plate is at a vertically higher position than the rear edge of the plate.

The desired setting angle or angle of attack of the smoothing plate depends on various parameters. These parameters include the amount of material compaction performed by the tamper, the amount of vibrational compaction if the smoothing plate has a vibration drive, the paving speed, the load-bearing capacity of the paving material, the weight of the screed and the desired thickness of the course or formed mat of paving material. Generally, tamper compaction and paving speed have the greatest effect on determining an appropriate setting angle of the smoothing plate.

An increase in tamper power leads to smaller setting angles of the screed, if the parameters otherwise remain unchanged. When the tamper power is increased, the tamper bar operates with a high amount of force, and combined with the screed weight and vibration (if any) acting on the screed, the following smoothing plate is capable of achieving only a limited amount of subsequent or "follow-up" compaction. The limit of the floating behavior of the screed is reached when the tamper bar is operated such that the bar substantially completely compacts the paving material. In that case, the following smoothing plate no longer has any effect on the paving material, so that the setting angle of the screed plate is therefore about 0° (i.e., the plate is generally horizontal or level). Thus, the amount of tamper compaction must be reduced in order to operate the smoothing plate with a positive setting angle/angle of attack. Additionally, an increase in the paving speed also increases the setting angle.

Differences in the setting angle of the smoothing plate result in different degrees of compaction or compaction density in the formed mat of paving material. Although the finished course or mat of paving material preferably has an even or level surface, differences in the degree of compaction produced by the screed may result in an uneven mat profile being produced by subsequent rolling work. In other words, during subsequent rolling (e.g., with a compactor machine), the material settles to a greater extent at points on the material mat where lower precompaction by the screed has occurred than at points where the material has been pre-compacted to a greater extent.

It is known, for example from German Patent Application No. DE 40 40 029 C1, to measure the paving speed and to vary the frequency of the drive of a compacting assembly, particularly a tamper bar, according to a predetermined desired-value curve, in order to keep compaction generally equal at all points on the mat of paving material. However, on account of the dominant effect of tamper compaction, this method of controlling quality of paving operations is highly inaccurate as there is no proportional behavior between the compaction changes resulting from the paving speed change and the tamper frequency change.

Therefore, the object of the present invention is to provide a paver which allows more accurate compaction regulation and which accounts for the actual prevailing circumstances of the screed operation.

SUMMARY OF THE INVENTION

The present invention is paver comprising a chassis and a trailing floating screed articulated on the chassis via tension arms. The screed has a setting angle relative to a ground surface that is capable of being adjusted via actuating cylinders. The screed includes at least one tamper bar, the tamper bar being movable in upward and downward directions by means of a drive and having a variable number of strokes, and a bottom-side smoothing plate. At least one sensor for measuring the setting angle is provided in the vicinity of a rear end of the screed. The sensor is connected to an associated controller configured for controlling the number of strokes of the tamper bar in order to adjust the setting angle to a predetermined desired value.

BRIEF DESCRIPTION OF THE SEVERAL VIEWS OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings.

DETAILED DESCRIPTION OF THE INVENTION

Figure 1:
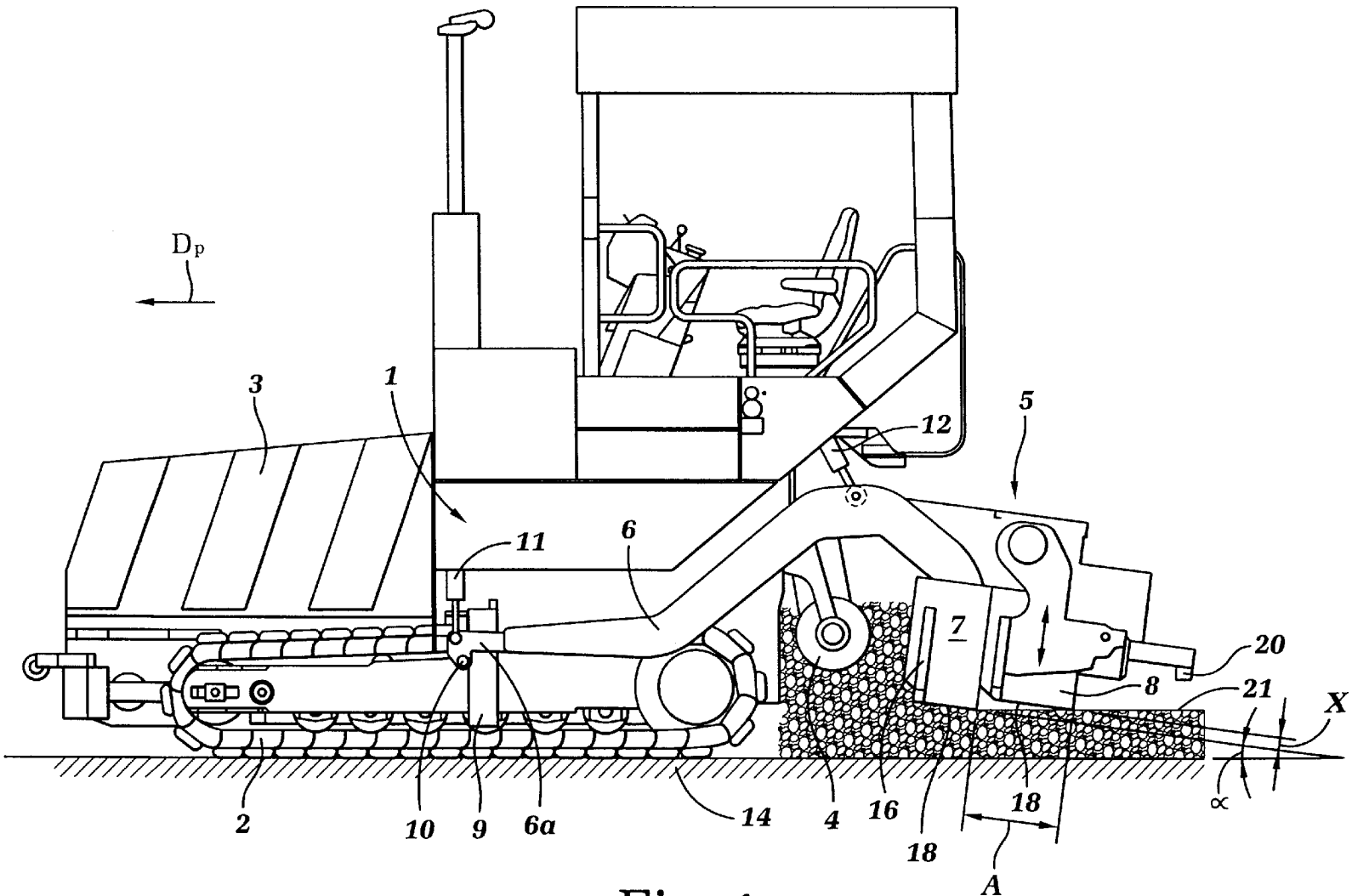
FIG. 1 is a side elevational view of a paver having a in accordance with the present invention.
Figure 2:
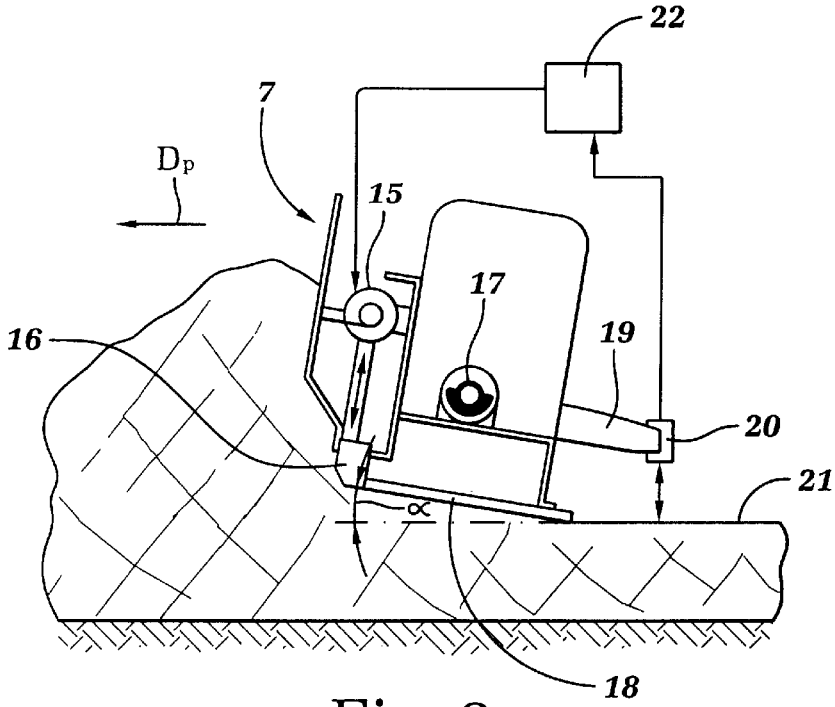
FIG. 2 is a broken-away, enlarged side plan view of a screed showing one construction of a sensor device.
Figure 3:
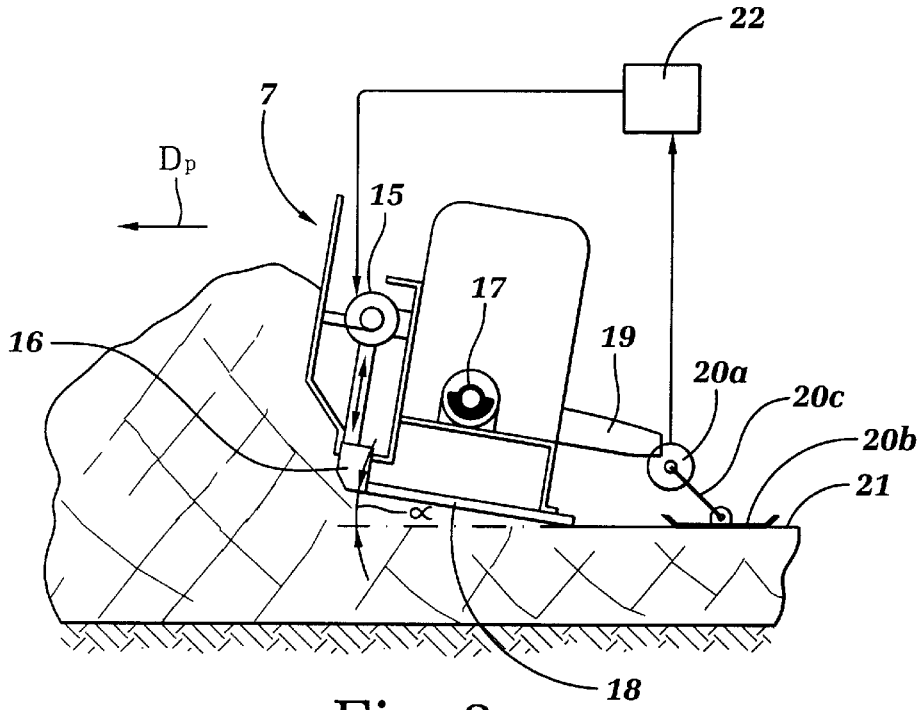
FIG. 3 is a broken-away, enlarged side plan view of a screed showing another construction of the sensor device.

Referring now to the drawings in detail, wherein like numbers are used to indicate like elements throughout, there is shown in FIGS. 1–3 a paver having an improved screed assembly 5 in accordance with the present invention. The paver preferably comprises a chassis 1 with crawler-type traveling mechanisms or "crawlers" 1*a*, although the chassis may additionally or alternatively be provided with wheels (none shown). The chassis 1 has a hopper 3 at a front end and a distributor auger 4 at a rear end. A conveyor (not depicted) extends between the hopper 3 and the auger 4 and is used for transporting a mix of paving material from out of the hopper 3, through a conveyor shaft extending below paver machine superstructure (which includes an operator station), and into the region or vicinity of the distributor auger 4.

A floating screed 5 or screed assembly 5 for the floating paving of a mix of paving material is articulated on the chassis 1 via a pair of tension arms 6 (only one depicted). The screed assembly 5 is located behind or rearward of the distributor auger 4 and preferably comprises a basic or main screed 7 and one or more (typically two) extendible screeds 8. Each extendible screed 8 is capable of being extended laterally with respect to the main screed 7 independently of the other screed 8. The main screed 7 is preferably centrally divided into two halves which are capable of being inclined relative to each other for the purpose of establishing a roof profile of the finished material mat transversely to the paving direction $D_P$.

With the above-described structure, the screed assembly 5 is capable of being widened or extended to substantially double the width of the main screed 7 by means of the extendible screeds 8. If additional widening of the screed assembly 5 is desired or if the screed assembly 5 does not include extendible screeds 8, manually attachable screed sections (none shown) may be attached to the outer ends of the extendible screeds 8 or the main screed 7. The extendible screeds 8 are generally offset by the amount of one screed depth "A" relative to the main screed 7 with respect to the paving direction $D_P$, as shown in FIG. 1.

The front end of each tension arm 6 is attached to the chassis 1 such that the arms 6 are pivotably articulated on the chassis 1, and preferably the point of articulation or attachment of each arm 6 is vertically adjustable relative to the chassis 1. Preferably, each tension arm 6 has a forked end portion 6*a* engaged about a generally flat bar 9 attached to the chassis 1. Each forked end 6*a* is supported on the flat bar 9 by a bearing ring or roller of a bearing 10 disposed through the forked portion 6*a*, the bearing 10 absorbing tensile forces acting upon the arm 6.

Further, an actuating cylinder 11 (e.g., a hydraulic cylinder) is engaged with the forked end 6*a* of each tension arm 6. In order to vary the paving thickness or for leveling the screed assembly 5, the actuating cylinder 11 adjusts the height of the articulation point of each tension arm 6 relative to the chassis 1, with the result that the setting angle $\alpha$ of the screed assembly 5 relative to the ground surface 14 is also adjusted. A second or additional actuating cylinder 12 serves for raising the entire screed assembly 5 into a transport position. When the paver is performing a paving operation, the actuating cylinder 12 is configured to allow the screed assembly 5 to float upon the paving material.

In order for the paved course or formed mat of material to be even across its transverse profile (without or with a roof profile or inclination), the rear edge of the basic screed 7 and the rear edges of the extendible screeds 8 must each be at substantially the same height, irrespective of whether the screed assembly 5 is arranged to form a roof profile or a transverse inclination in the finished mat of material. Since the extendible screeds 8 are located further from the articulation point of the tension arms 6 than is the main screed 7, the extendible screeds 8 must be adjusted in height (i.e., vertically adjusted) relative to the basic screed 7 by the amount of a dimension X, as shown in FIG. 1. Therefore, changes in the setting angle $\alpha$ have to be compensated for by a corresponding change in the dimension X in order to maintain an even surface of the formed material mat.

Further, the main screed 7 (and also the extendible screeds 8) also includes at a lower, bottom-side or base portion thereof one or more compacting tools or devices, preferably at least one tamper bar 16. The tamper bar 16 is movable in upward and downward directions by a predeterminable, adjustable stroke via a drive 15. Preferably, the drive 15 is constructed as an eccentric type of drive and is adjustable in respect of the number of strokes of the tamper bar 16. In other words, the drive 15 is preferably configured so as to be capable of varying the stroke rate or stroke frequency (i.e., the number of strokes per a unit of time) of the tamper bar 16. Further, the main screed 7 also includes a smoothing plate 18, also referred to as a screed plate 18, disposed rearwardly of the tamper bar 16, which is preferably coupled to a vibrating drive 17 mounted to the main screed 7. Alternatively, the main screed 7 may be constructed without any vibrating drive.

Referring to FIG. 2, the screed assembly 5 further includes a sensor 20, for example an ultrasonic sensor, which is preferably disposed on a jib 19 or jib-like beam 19 extending rearwardly from the main screed 7 (and from at least one of the extendible screeds 8, if any). The sensor 20 is configured to measure the distance from the sensor 20 to the upper surface 21 of the material mix just paved, in other words, the portion of the formed mat of material immediately adjacent to the rear end of the screed 5. The sensor 20 delivers or transmits signals to a controller 22, the controller 22 being configured to either directly control the number of strokes of the tamper bar 16 (the stroke rate) or to control the rotational speed of the drive 15. With this sensor arrangement, a decrease in the distance between the sensor 20 and the surface 21 indicates that the setting angle $\alpha$ of the screed assembly 5 has become greater (i.e., increased to a greater magnitude), and vice-versa.

A desired setting angle $\alpha$ is selected and regulated in order for the screed 5 to accomplish a desired amount of material compaction, such that the number of strokes (or stroke rate) of the tamper bar 16, and thus the compacting power of the bar 16, is varied or adjusted according to deviations in the measured setting angle $\alpha$ from the desired value thereof. Preferably, the controller 22 is configured to disregard measured values within an appropriate "dead" bandwidth, such that slight fluctuations in the setting angle $\alpha$, which occur due to movement or adjustment of the height of the screed assembly 5, do not affect the regulation of the tamper bar 16. Further, since the sensor 20 does not measure the distance perpendicularly to the surface 21 according to the setting angle $\alpha$, correction values must also be included in the regulation in accordance with the setting angles $\alpha$.

Alternatively to having single sensor 20, the screed assembly 5 may include a plurality of sensors 20 provided on the main screed 7 and/or on the extendible screeds 8 and spaced from each other transversely with respect to the paving direction $D_P$ (i.e., spaced laterally across the width of the screed assembly 5), such that average of the measured values of all of the sensors 20 is used for regulation of the paving operation.

Referring to FIG. 3, the sensor 20 may alternatively comprise a potentiometer 20*a* and a probe 20*b*, preferably a sliding block 20*b*. An arm 20*c* is coupled to the block 20*b* in an articulated manner and connects the block 20*b* to a sliding or wiping contact of the potentiometer 20*a*. The sliding block 20*b* is disposed upon the upper surface 21 of the just paved or formed mat of paving material (i.e., adjacent to the rear end of the screed assembly 5). The angle of the arm 20*c* with respect to the surface 21 corresponds to values of the setting angle $\alpha$ of the screed assembly 5, such that a particular value of the angle of the arm 20*c* corresponds to the desired setting angle $\alpha$. With this sensor arrangement, changes in the angle of the arm 20*c* cause the wiping contact of the potentiometer 20*a* to move, such that the potentiometer 20*a* delivers or transmits to the controller 22 a measured value which is correlated with the setting angle $\alpha$.

With either form of sensor 20, the operation of the screed assembly 5 is regulated by monitoring the setting angle $\alpha$ in order to regulate or adjust the tamper power and therefore the amount of material compaction. Since the parameters relating to the weight of the screed assembly 5, vibration, course thickness and load-bearing capacity of the mix of paving material have only a minor influence on the setting angle $\alpha$ and are generally varied only rarely for a particular paving operation, the regulation is in particular, in regard to the negative influence of the paving speed change.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A paver comprising a chassis and a trailing floating screed articulated on the chassis via tension arms and of which a setting angle relative to a ground surface is capable of being adjusted via actuating cylinders and which includes at least one tamper bar, the tamper bar being movable in upward and downward directions by means of a drive and having a variable number of strokes, and a bottom-side smoothing plate, wherein at least one sensor for measuring the setting angle is provided in the vicinity of a rear end of the screed, the sensor being connected to an associated controller configured for controlling the number of strokes of the tamper bar in order to adjust the setting angle to a predetermined desired value.

2. The paver according to claim 1 wherein a plurality of sensors are provided on the screed, the sensors being spaced laterally across the screed.

3. The paver according to claim 2 wherein the screed includes a main screed and at least one extendible screed capable of being extended laterally from the main screed, the main screed carrying at least one sensor and the extendible screed carrying a sensor.

4. The paver according to claim 1 wherein the at least one sensor is an ultrasonic at least one sensor configured to measure a distance from the at least one sensor to a surface of an adjacent portion of a mat of paving material.

5. The paver according to claim 4 wherein the distance measured by the at least one sensor to the surface of the mat of paving material is used, corrected according to the respective setting angle, as a regulation variable.

6. The paver according to claim 1 wherein the at least one sensor includes a potentiometer and a probe disposed upon an adjacent portion of formed mat of paving material and connected with the potentiometer, the potentiometer being configured to measure an angle of the probe with respect to the mat of material.

7. The paver according to claim 6 wherein the measured angle of the probe is used as a regulation variable.

8. The paver according to claim 1 wherein the controller is configured to disregard sensor measurements within a dead bandwidth about the desired value of the setting angle.

* * * * *